US008106589B2

(12) United States Patent
Shido et al.

(10) Patent No.: US 8,106,589 B2
(45) Date of Patent: Jan. 31, 2012

(54) DIRECT-CURRENT HIGH VOLTAGE DISCHARGE BULB FOR VEHICLE LAMP

(75) Inventors: Masaya Shido, Shizuoka (JP); Yoichiro Domae, Shizuoka (JP)

(73) Assignee: Koito Manufacturing Co, Ltd., Tokyo (JP)

( * ) Notice: Subject to any disclaimer, the term of this patent is extended or adjusted under 35 U.S.C. 154(b) by 946 days.

(21) Appl. No.: 11/717,624

(22) Filed: Mar. 14, 2007

(65) Prior Publication Data

US 2007/0216310 A1 Sep. 20, 2007

(30) Foreign Application Priority Data

Mar. 14, 2006 (JP) ..... 2006-068499

(51) Int. Cl.
*H01J 17/16* (2006.01)
*H01J 17/20* (2006.01)

(52) U.S. Cl. ..... 313/634; 313/573; 220/2.1 R

(58) Field of Classification Search ..... 313/634, 313/113, 573; 220/2.1 R
See application file for complete search history.

(56) References Cited

U.S. PATENT DOCUMENTS 2,130,304 A * 9/1938 Lemmers ..... 313/40
2,896,107 A * 7/1959 Anderson, Jr. ..... 313/570
4,503,356 A * 3/1985 Kobayashi et al. ..... 313/634
4,724,361 A * 2/1988 Wada et al. ..... 315/246
6,054,811 A * 4/2000 Genz et al. ..... 313/634
2002/0063503 A1* 5/2002 Tsuda et al. ..... 313/113
2004/0150343 A1* 8/2004 Takahashi et al. ..... 313/623
2005/0146275 A1* 7/2005 Fukuyo et al. ..... 313/641
2005/0255783 A1* 11/2005 Hirata et al. ..... 445/26

FOREIGN PATENT DOCUMENTS

DE 10 2004 061 302 A1 7/2005
DE 102 31 127 B4 9/2008
EP 173347 A1 * 3/1986
JP 06-314556 A 11/1994
JP 10-188893 7/1998
JP 2004-362978 A 12/2004

OTHER PUBLICATIONS

Machine translation of JP 06-314556.*
Japanese Notice of Reasons for Rejection, dated Mar. 24, 2011, issued in Application No. 2006-068499.
Office Action dated Jul. 15, 2011 from the German Patent & Trademark Office in counterpart German application No. 102007010551.9.

* cited by examiner

*Primary Examiner* — Nimeshkumar Patel
*Assistant Examiner* — Anthony Perry
(74) *Attorney, Agent, or Firm* — Sughrue Mion, PLLC

(57) ABSTRACT

A direct-current high-voltage discharge bulb includes a ceramic arc tube body having a discharge emission chamber at a middle portion in a longitudinal direction thereof, a light-emitting substance which is sealed inside the discharge emission chamber together with a starting rare gas, and an anode and a cathode which are disposed so as to face each other inside the discharge emission chamber. An inside diameter of the ceramic arc tube body where the discharge emission chamber is defined is made to gradually decrease from the anode side to the cathode side.

11 Claims, 7 Drawing Sheets

ΔCCT(K): DIFFERENCE IN COLOR TEMPERATURE WITHIN ± 1.6 mm FROM CENTER BETWEEN ELECTRODES

| ZnI2 CONTENT (WEIGHT PERCENT %) | | | | | | |
|---|---|---|---|---|---|---|
| 25 | - | - | - | - | - | - |
| 20 | - | 1150 | - | - | - | - |
| 15 | - | 830 | 860 | 990 | 1500 | 2260 |
| 10 | - | 790 | - | 960 | - | - |
| 5 | - | - | - | - | - | - |
| 0 | 700 | 760 | - | 810 | 1030 | 1210 |
| NaI CONTENT (WEIGHT PERCENT %) | 40 | 50 | 60 | 70 | 80 | 90 |

DIRECT-CURRENT HIGH VOLTAGE DISCHARGE BULB FOR VEHICLE LAMP

The present invention claims priority from Japanese Patent Application No. 2006-068499 filed on Mar. 14, 2006, the entire content of which is incorporated herein by reference.

BACKGROUND OF INVENTION

1. Field of the Invention

The present invention relates to a discharge bulb suitable for a light source of a vehicle lamp, the discharge bulb including a ceramic arc tube body (an arc tube made of ceramic) inside which discharge electrodes are provided so as to face each other and a light-emitting substance (such as a metal halide) is sealed therein together with a starting rare gas. In particular, the present invention relates to a high-pressure discharge bulb for a vehicle lamp, to which a direct-current lighting method is applied.

2. Description of the Related Art

A discharge bulb having a glass arc tube body (an arc tube made of a glass tube) is generally used as a light source of a vehicle headlamp. However, there has been a problem that a corrosion of the glass tube is caused to progress due to a light-emitting substance (a metal halide) sealed inside the glass tube, thereby causing a blackening or a transparency losing phenomenon to appear, whereby a proper light distribution cannot be obtained and the life of the glass bulb does not last so long.

Therefore, in recent years, discharge bulbs have been proposed which includes a ceramic arc tube body in which discharge electrodes are provided to face each other and a light-emitting substance is sealed therein together with a starting rare gas (see, e.g., JP-A-2004-362978). More specifically, as shown in FIG. 9, molybdenum pipes 212 are joined to each of the thin tube portions 201 of a ceramic tube 200 on respective sides by a metallization, electrode rods 214 are inserted through the interior of each of the molybdenum pipes 212 in such a manner that distal end portions of the electrode rods 214 project into the interior of (a discharge emission chamber S of) the ceramic tube 200, and rear end portions of the electrode rods 214 are joined (welded) to respective rear end portions of the molybdenum pipes 212 projecting from the ceramic tube 200, whereby respective end portions (the thin tube portions 201 communicating with the discharge emission chamber S) of the ceramic tube 200 are sealed (welded portions 218 being electrode sealing portions at respective ends of the arc tube body). Since the ceramic tube 200 is stable with respect to the light-emitting substance (metal halide) that is sealed therein, the ceramic arc tube body has a longer life than the glass arc tube body. Reference numeral 215 denotes a minute gap between the molybdenum pipe 212 and the electrode rod 214.

Currently, in view of downsizing a system and reducing a production cost, there is also a movement to develop a high-pressure discharge bulb using a direct-current lighting method. Such a high-pressure discharge bulb for a liquid crystal back light was found as a high-pressure discharge bulb in which a ceramic arc tube body is lit by a direct-current lighting method (see, e.g., JP-A-10-188893).

However, the high-pressure discharge bulb shown in JP-A-10-188893 is for a liquid crystal back light, and hence, it cannot be used as a light source of a vehicle lamp which desirably requires a white luminescence that is free from color unevenness.

More specifically, in case of the direct-current lighting method, a cataphoresis phenomenon is generated in which a light-emitting substance is separated into positive and negative ions in association with polarities of electrodes while being lit. Color unevenness in an electric arc attributed to the cataphoresis phenomenon is unavoidable. Nevertheless, such a color unevenness can be mitigated (absorbed) to some extent by using a ceramic tube which has a low linear transmission factor (e.g., 80% or less) compared with a glass tube so that an emitted light is diffused. However, in the process of developing a high-pressure discharge bulb using the direct-current lighting method for use in a light source of a vehicle lamp, there was a primary problem that the color unevenness in the electric arc is not sufficiently mitigated (absorbed) only by using such a ceramic tube. Furthermore, irrespective of the fact that a suitable amount of light-emitting substance is sealed inside the discharge emission chamber S, there was a secondary problem that performance characteristic is decreased and a luminous flux is decreased.

SUMMARY OF INVENTION

In view of the above, it is an object of the present invention to provide a direct-current high-voltage discharge bulb for a vehicle lamp in which a color unevenness in an electric arc is made less conspicuous, and performance characteristic and a luminous flux do not decrease.

According to one or more aspects of the invention, a direct-current high-voltage discharge bulb includes a ceramic arc tube body having a discharge emission chamber at a middle portion in a longitudinal direction thereof, a light-emitting substance which is sealed inside the discharge emission chamber together with a starting rare gas, and an anode and a cathode which are disposed so as to face each other inside the discharge emission chamber. An inside diameter of the ceramic arc tube body where the discharge emission chamber is defined is made to gradually decrease from the anode side to the cathode side.

DESCRIPTION OF EXEMPLARY EMBODIMENTS

Figure 1:
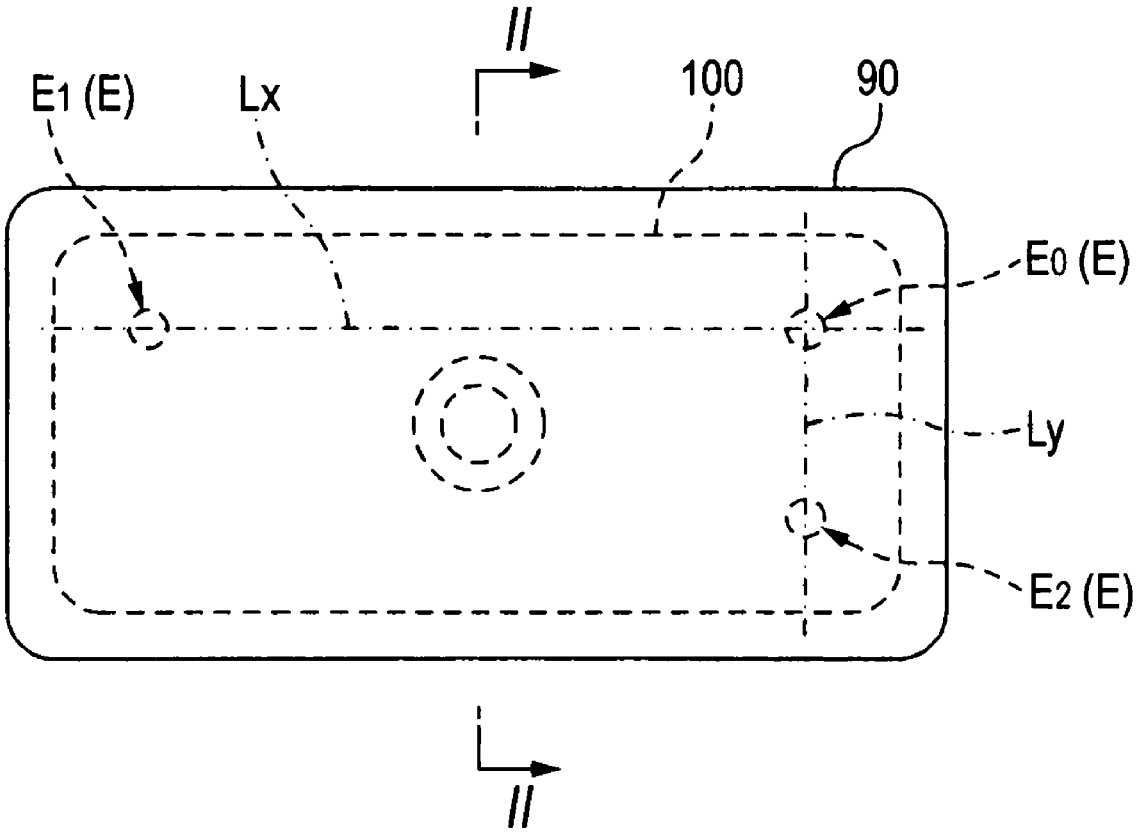
FIG. 1 is a front view of a vehicle headlamp which utilizes a direct-current high-voltage discharge bulb according to a first exemplary embodiment of the invention as a light source.

In connection with the primary problem discussed above, the color unevenness in electric arc is amplified due to an uneven temperature distribution in the arc tube body (the discharge emission chamber) when being lit. More specifically, the temperature is high on the anode side while being low on the cathode side. For this reason, the color unevenness in the electric arc is not sufficiently mitigated (absorbed) only by use of the ceramic tube which diffuses emitting light.

In connection with the secondary problem, the temperature on the cathode side is lower than the anode side where it is heated to a high temperature by virtue of frequent bombardment of electrons against the electrode, and the light-emitting substance (the metal halide) inside the minute gap at the electrode sealing portion where it is a coldest point becomes liquefied or solidified, and hence, becomes unable to return to the discharge emission chamber. For this reason, the amount of light-emitting substance which contributes to luminescence substantially decreases, whereby the performance characteristic is decreased or the luminous flux is decreased.

In light of the above, it is found that, if the thermal capacity of the arc tube body is made smaller on the cathode side than on the anode side, firstly, the temperature of the cathode side of the arc tube body would be increased while being lit so that the unevenness in temperature distribution in the arc tube body would be reduced, whereby the color unevenness in the electric arc would not be amplified, thereby making it possible to sufficiently mitigate (absorb) the color unevenness in the electric arc by using the ceramic tube capable of diffusing the emitting light. Secondly, the coldest point would then move from the vicinity of the cathode to the anode side by virtue of an increase in temperature on the cathode side of the arc tube body so that the electrode sealing portion on the cathode side would not be the coldest point, whereby the light-emitting substance would not be liquefied or solidified in the minute gap in the electrode sealing portion on the cathode side.

Accordingly, in order to reduce the thermal capacity of the arc tube body on the cathode side than on the anode side, in contrast to an arc tube body (a discharge emission chamber) of the related art in which an inside diameter is made uniform along an axial direction (a longitudinal direction), the inventors have experimentally produced an arc tube body (a discharge emission chamber) having an inside diameter that gradually decreases from an anode side to a cathode side. Further, verifications were made on the color unevenness in electric arc, the performance characteristic and luminous flux of the bulb, whereby the arc tube body was effective in solving the above discussed primary and secondary problems.

Hereinafter, exemplary embodiments of the invention will be explained with reference to the drawings. The following exemplary embodiments do not limit the scope of the invention.

FIGS. 1 to 7 show a first exemplary embodiment of the invention.

In the drawings, reference numeral 80 denotes a receptacle-shaped lamp body of the vehicle headlamp which opens on a front side thereof, and a transparent front cover 90 is assembled to a front opening of the lamp body, whereby a lamp chamber C is defined. A reflector 100 which forms a low beam is housed in the lamp chamber C. The reflector 100 is formed with a bulb mounting hole 102 at a rear apex portion thereof, and a direct-current high-voltage discharge bulb V is inserted and attached through the bulb mounting hole 102. A reflecting surface is formed on an internal side of the reflector 100 by an aluminum deposition, and an effective reflecting surface 101 is formed on an upper half portion of the reflector 100. The effective reflecting surface 101 includes a plurality of light distribution control steps (multiple reflecting surfaces) each having a different shape of curved surface. A light emitted from the bulb V is reflected by the effective reflecting surface 101 and is forwardly irradiated, whereby a low beam light distribution pattern (see FIGS. 5, 6) is formed with a predetermined cut-off line CL.

As shown in FIG. 1, an aiming mechanism E is interposed between the reflector 100 and the lamp body 80. The aiming mechanism E includes one aiming fulcrum E0 which is structured as a ball joint, and two aiming screws E1, E2, so that an optical axis L of the reflector 100 (the headlamp) can be tilted (or the optical axis L of the headlamp can be adjusted for aiming) around a horizontal tilting axis Lx and a vertical tilting axis Ly.

Reference numeral 30 denotes an insulating base made of a PPS resin. A focusing ring 34 is provided around an outer circumference of the insulating base, and is engaged with the bulb mounting hole 102 of the reflector 100. The discharge bulb V is configured such that an arc tube 10 is fixedly supported in front of the insulating base 30 by a metallic lead support 36 and a metallic support member 60. The metallic lead support 36 extends forward from the insulating base 30 and serves as an energizing path. The metallic support member 60 is fixed to a front surface of the insulating base 30.

More specifically, a lead wire 18*a* which is led out from a front end portion of the arc tube 10 is fixed to a distal end portion of the bent lead support 36 by a spot welding, whereby the front end portion of the arc tube 10 is supported on the distal end portion of the bent lead support 36. On the other hand, a lead wire 18*b* which is led out from a rear end portion of the arc tube 10 is connected to a terminal 47 which is provided at a rear end portion of the insulating base 30, and the rear end portion of the arc tube 10 is held by the metallic support member 60.

A recessed portion 32 is formed on a front end portion of the insulating base 30, and the rear end portion of the arc tube 10 is housed and held inside the recessed portion 32. A circular pillar-shaped boss 43 is formed at the rear end portion of the insulating base 30 in such a manner as to be surrounded by an outer cylindrical portion 42 which extends rearward. A cylindrically shaped belt-type terminal 44 is connected to the lead support 36, and is fixedly integrated to an outer circumference of a root portion of the outer cylindrical portion 42. A cap-type terminal 47, to which the lead wire 18*b* on the rear end side is connected, covers the boss 43 so as to be integrated thereto.

Figure 3:
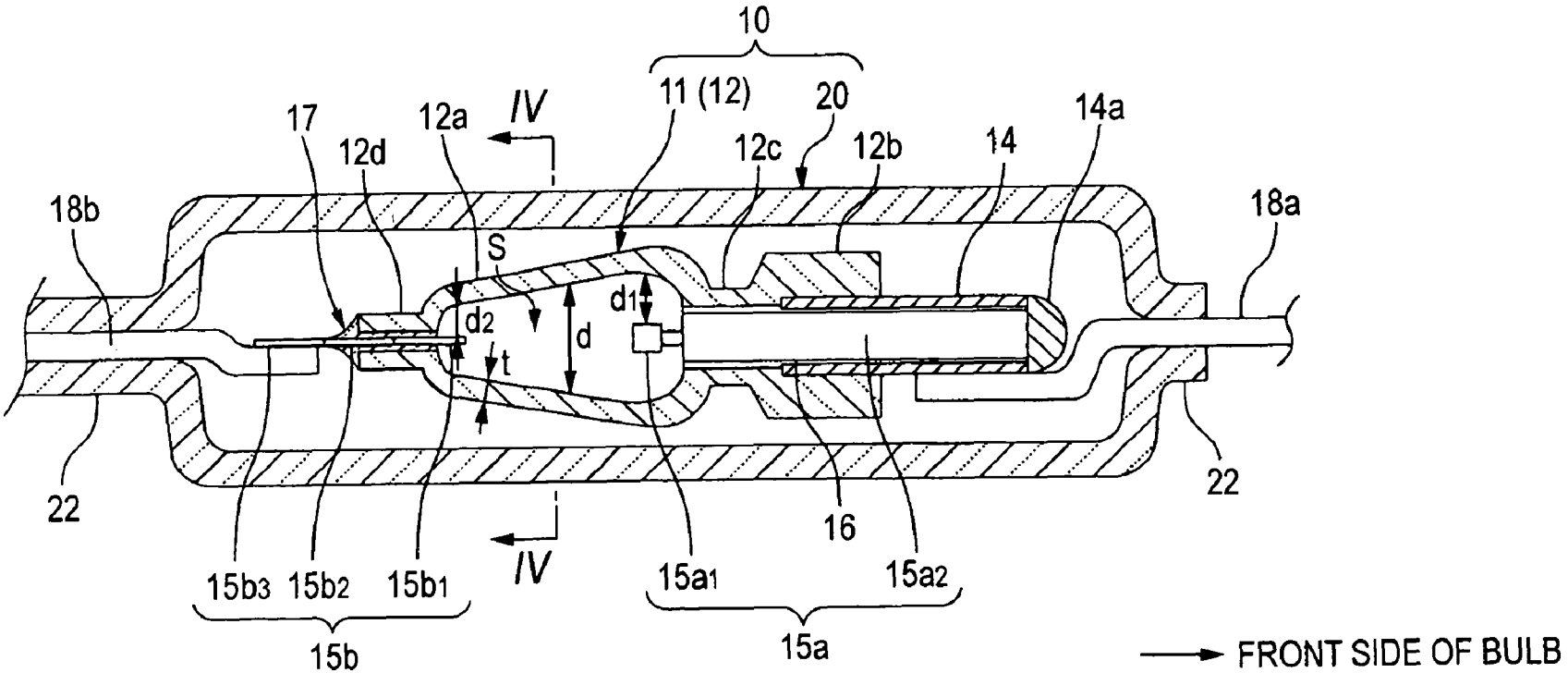
FIG. 3 is an enlarged vertical longitudinal sectional view of an arc tube of the discharge bulb.
Figure 4:
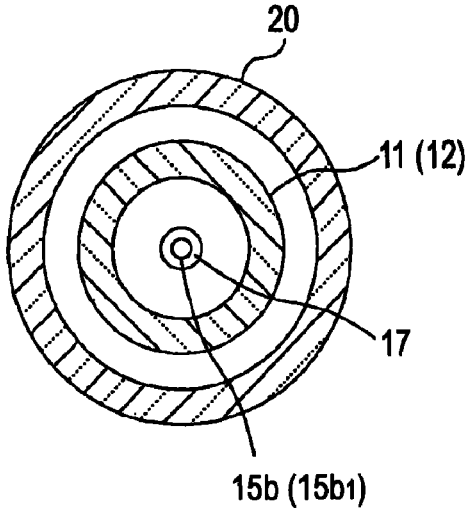
FIG. 4 is a vertical cross-sectional view of the arc tube (a sectional view taken along the line IV-IV shown in FIG. 3)

As shown in FIG. 3, the arc tube 10 includes an arc tube body 11 and a cylindrical ultraviolet radiation shielding shroud glass 20 which covers the arc tube body 11, the arc tube body 11 and the cylindrical ultraviolet radiation shielding shroud glass being integrated with each other. The arc tube body 11 has a discharge emission chamber S in which rod-shaped electrodes 15*a*, 15*b* are provided so as to face each other, in which a light-emitting substance including such as NaI, $ScI_3$ and $ZnI_2$ is sealed together with a starting rare gas. The rod-shaped electrodes 15*a*, 15*b* project into the discharge emission chamber S such that a distance therebetween is 4.2 mm. The lead wires 18*a*, 18*b* are electrically connected to respective rod-shaped electrodes 15*a*, 15*b*, and are led out from front and rear end portions of the arc tube body 11. The ultraviolet radiation shielding shroud glass 20 is sealed (seal secured) to these lead wires 18*a*, 18*b*, whereby the arc tube body 11 and the shroud glass 20 are integrated with each other. Reference numeral 22 denotes a diametrically contracted sealing portion of the shroud glass 20. A light shielding film (not shown) for forming a cut-off line CL is formed on an external surface of the shroud glass 20, so that a light emitted from the arc tube body 11 is guided mainly on to the effective reflecting surface 101 of the reflector 100.

The arc tube body 11 is formed by a light transmitting ceramic tube 12 having a linear transmission factor of 80% or less. The ceramic tube 12 is formed substantially in a cylindrical shape. The ceramic tube 12 includes a discharge emission portion 12*a* at a middle portion in a longitudinal direction thereof, the discharge emission portion 12*a* having a maximum inside diameter of 2.3 mm and a maximum outside diameter of 3.0 mm. The discharge emission portion 12*a* defines the discharge emission chamber S whose volume is 20 μl. The ceramic tube 12 further includes a large-diameter thin tube portion 12*b* formed on a front end side (an anode side which is a right-hand side in FIG. 3) thereof, and a small-diameter thin tube portion 12*d* formed on a rear end side (a cathode side which is a left-hand side in FIG. 3) thereof. The large-diameter thin tube portion 12*b* has larger inside and outside diameters and communicates with the discharge emission chamber S of the discharge emission portion 12*a*, and a constricted portion 12*c* is formed between the large-diameter thin tube portion 12*b* and the discharge emission portion 12*a*. On the other hand, the small-diameter thin tube portion 12*d* has smaller inside and outside diameters and also communicates with the discharge emission chamber S of the discharge emission portion 12*a*.

A molybdenum pipe 14 is fixed to an inner circumference of the large-diameter thin tube portion 12*b* on an opening side by a metallization joining such that the molybdenum pipe 14 projects from the large-diameter thin tube portion 12*b*. The large-diameter rod-shaped electrode 15*a* is inserted through the interior of the molybdenum pipe 14 in such a manner that a distal end portion thereof projects into the interior of the discharge emission chamber S. A rear end portion of the large-diameter rod-shaped electrode 15*a* is securely welded (joined) to a projecting end portion of the molybdenum pipe 14, whereby the large-diameter rod-shaped electrode 15*a* is integrated with the ceramic tube 12, and the interior of the large-diameter thin tube portion 12*b* which communicates with the discharge emission chamber S is sealed off. Reference numeral 14*a* denotes a laser weld.

The large-diameter rod-shaped electrode 15*a* includes a stepped tungsten electrode rod 15*a*1 on a distal end side and a thick molybdenum rod 15*a*2 on a proximal end side that are joined together coaxially into an integral unit. The laser weld 14*a* serves as an electrode sealing portion on the anode side of the arc tube body 11. Between the molybdenum pipe 14 and the molybdenum rod 15*a*2 of the rod-shaped electrode 15*a*, a minute gap 16 on the order of 25 μm is formed, whereby the rod-shaped electrode 15*a* can be inserted through the molybdenum pipe 14 and a thermal stress generated in the large-diameter thin tube portion 12*b* can be absorbed.

On the other hand, the small-diameter rod-shaped electrode 15*b* is inserted through the interior of the small-diameter thin tube portion 12*d* which lies on the rear end side of the ceramic tube 12, and is joined to the interior of the small-diameter thin tube portion 12*d* by a frit seal so as to be integrated therewith. The small-diameter rod-shaped electrode 15*b* includes a tungsten rod 15*b*1 on a distal end side, a molybdenum rod 15*b*2 at a middle portion, and a niobium rod 15*b*3 on a rear end side that are joined together into an integral unit. The tungsten rod 15*b*1 on the distal end side projects into the discharge emission chamber S, the niobium rod 15*b*3 on the rear end side projects largely from the small-diameter thin tube portion 12*b*, and the molybdenum rod 15*b*2 at the middle portion is integrated with the small-diameter thin tube portion 12*b* from the interior of the thin tube portion 12*b* to an end face of the thin tube portion 12*b* by a glass welding. A glass weld 17 serves as an electrode sealing portion on the cathode side of the arc tube body 11.

A bent portion on a distal end side of the lead wire 18*a* on the front end side is fixed to the molybdenum pipe 14 which projects from the front end portion of the arc tube body 11 (from the large-diameter thin tube portion 12*b* on the front end side of the ceramic tube 12) by welding, and a bent portion on a distal end side of the lead wire 18*b* on the rear end side is fixed to the niobium rod 15*b*3 of the rod-shaped electrode 15*b* which projects from the rear end portion of the arc tube body 11 (from the small-diameter thin tube portion 12*d* on the rear end side of the ceramic tube 12) by welding, whereby the arc tube body 11 (the ceramic tube 12) and the lead wires 18*a*, 18*b* are disposed coaxially (see FIG. 3).

On the anode side of the arc tube body 11 which is lit by a direct-current lighting method, electrons frequently collide against the electrode, whereby the electrode is drastically depleted. Therefore, an electrode distal portion 15*a*1 having a large-diameter is formed on the distal end side of the tungsten rod 15*a* which serves as the anode so as to secure durability (to ensure a long-term usage).

In addition, with the arc tube body 11 which is lit by the direct-current lighting method, a cataphoresis phenomenon is generated in which a light-emitting substance is separated into positive and negative ions in association with polarities of the electrodes while being lit, whereby Na ions are collected on the cathode side, and a red light is emitted on the cathode side of an electric arc. Thus, color unevenness is generated in the electric arc. Moreover, a temperature is lower on the cathode side of the arc tube body 11 than on the anode side where it is heated to a high temperature due to collision of the electrons. For this reason, the temperature distribution of the arc tube body 11 (the discharge emission chamber S) becomes uneven while it is being lit in such a way that the temperature becomes higher on the anode side and lower on the cathode side, whereby the color unevenness in the electric arc is amplified. Therefore, the color unevenness in the electric arc cannot be sufficiently mitigated (absorbed) only by using the ceramic tube 12. Further, there is a risk that the light-emitting substance may be liquefied or solidified inside the minute gap (the minute gap between the rod-shaped electrode 15*b* and the thin tube portion 12*d*) in the electrode sealing portion on the cathode side where it is a coldest point, so that such light-emitting substance cannot return to the discharge emission chamber S, whereby substantial quantity of light-emitting substance which contribute to luminescence decreases. As a result, there is fear that the performance characteristic decreases or the luminous flux decreases.

In the first exemplary embodiment, however, a thickness t of a tube wall which defines the discharge emission chamber S is formed to be substantially uniform along the longitudinal direction, and an inside diameter d of the tube wall is made smaller on the cathode side than on the anode side. Because of this, a distance d1 between the electrode and the tube wall becomes long on the anode side, whereas a distance d2 between the electrode and the tube wall becomes short on the cathode side, whereby the thermal capacity of the tube wall becomes smaller on the cathode side than on the anode side. Thus, the distance d1 is larger than the distance d2.

Therefore, the temperature distribution in the arc tube body 11 (the discharge emission chamber S) does not become uneven while it is being lit, but becomes substantially even between the anode side and the cathode side, whereby the color unevenness in the electric arc is not amplified. Accordingly, the color unevenness in the electric arc can be sufficiently mitigated (absorbed) by the use of the ceramic tube 12 having a low linear transmission factor (for example, 80% or less) and by which an emitted light is diffused.

In addition, the temperature on the cathode side of the arc tube body when lit is higher than the temperature on the cathode side of the arc tube body of the related art in which an inside diameter thereof is uniform in the longitudinal direction, and approaches the temperature on the anode side, whereby the coldest point moves from the vicinity of the cathode to the anode side (a position which lies slightly away from the cathode towards the anode side becoming a coldest point). Consequently, the light-emitting substance (metal halide) is not liquefied or solidified inside the minute gap (the minute gap between the small-diameter thin tube portion 12*d* and the small-diameter rod-shaped electrode 15*b*) in the electrode sealing portion on the cathode side, thereby eliminating the decrease in quantity of light-emitting substance contributing to luminescence in the discharge emission chamber S. As a result, it is possible to eliminate the risk that the performance characteristic decreases or the luminous flux decreases.

Further, there are no drastic changes in the inside diameter d of the tube wall in the longitudinal direction where the discharge emission chamber S is defined. Therefore, thermal shock resistance strength does not becomes inferior to that of the arc tube body having an uniform inside diameter of the tube wall along the longitudinal direction.

Still further, the volume of the small-diameter thin tube portion 12*d* is remarkably smaller than the volume of the large-diameter thin tube portion 12*b*, and the volume of the small-diameter rod-shaped electrode 15*b* on the cathode side is remarkably smaller than the volume of the large-diameter rod-shaped electrode 15*a* on the anode side. Therefore, the thermal capacity of the arc tube body 11 is smaller on the cathode side than on the anode side.

Therefore, the temperature on the cathode side of the arc tube body becomes much higher when it is being lit so that the unevenness in temperature distribution between the anode and the cathode of the discharge emission chamber S is further eliminated, whereby the amplification in color unevenness in electric arc is further suppressed.

Also, the coldest point further moves towards the anode side, whereby the light-emitting substance becomes more unlikely to be liquefied or solidified inside the minute gap in the electrode sealing portion on the cathode side.

Still further, since substantially the whole area of the minute gap between the small-diameter thin tube portion 12*b* and the small-diameter rod-shaped electrode 15 is glass welded (that is, a glass welding layer is filled in substantially the whole area of the minute gap between the small-diameter tin tube portion 12*d* and the rod-shaped electrode 15*b*), there exists almost no gap into which the light-emitting substance can intrude between the small-diameter thin tube portion 12*d* and the rod-shaped electrode 15*b*. Therefore, there is almost no risk that the quantity of light-emitting substance contributing to luminescence is decreased.

Meanwhile, although the minute gap 16 exists between an inner circumferential surface of the large-diameter thin tube portion 12*b* and the molybdenum pipe 14 and between the inner circumferential surface of the large-diameter thin tube portion 12*b* and the large-diameter rod-shaped electrode 15*b* on the anode side of the arc tube body 11, the coldest point when the arc tube body 11 is lit is located in a position which is sufficiently away from the anode side towards the cathode side. Therefore, there is no risk that the light-emitting substance is liquefied or solidified in the minute gap 16.

The color unevenness in the electric arc is mitigated (absorbed) by the ceramic tube 12 that has a low linear transmission factor (for example, 80% or less) and by which an emitted light is diffused, thereby making the color unevenness less conspicuous. Furthermore, according to the first exemplary embodiment, the white electric arc can be obtained in which the color unevenness is made much less conspicuous by adjusting the light-emitting substance sealed inside the discharge emission chamber S.

As a light-emitting substance, NaI is sealed inside the discharge emission chamber S. The content of NaI with respect to the whole light-emitting substance is in a range from 40% to 70% (in weight percent), whereby the luminescence of white electric arc is obtained in which unevenness in reddish tone is minor.

Figures 6, 7:
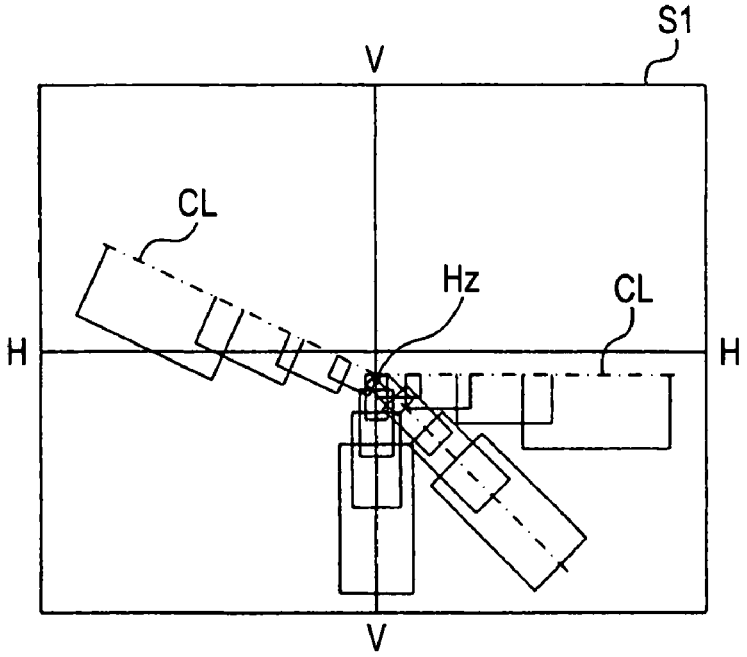
FIG. 6 is a front view of the light distribution screen onto which the light source image is projected (affixed)
FIG. 7 is a diagram showing a relationship between respective contents of NaI and $ZnI_2$ in a light-emitting substance sealed inside a discharge emission chamber and a permissible range of difference in color temperature.

More specifically, Na is a light-emitting substance which becomes luminous in red, and is sealed inside the discharge emission chamber S as NaI. As shown in FIG. 7, when the content of NaI in the light-emitting substance is in the range of 40% to 70% (in weight percent), the color unevenness in the electric arc (a difference in color temperature between red on the cathode side and blue on the anode side of the electric arc, and more particularly, a difference in color temperature (ΔCCT) in the electric arc within +/−1.6 mm from a center between the electrodes while a distance between the electrodes being 4.2 mm) falls within a permissible value (1000K or less), whereby a white light having a sufficient luminance is obtained in which the reddish tone in the electric arc (in particular, extreme luminescence in red on the cathode side of the electric arc) is suppressed. When the content of Na in the light-emitting substance exceeds 70% (in weight percent), the luminescence of Na on the cathode side becomes excessive (ΔCCT exceeds 1000K), and on the contrary, when the content of Na in the light-emitting substance becomes less than 40% (in weight percent), the luminescence efficiency is decreased. Therefore, the content of Na in the light-emitting substance is adjusted to fall within the range of 40% to 70% (in weight percent) where an white electric arc is obtained with little unevenness in reddish tone.

$ZnI_2$ is also sealed inside the discharge emission chamber S as a light-emitting substance, and the content of $ZnI_2$ in the whole light-emitting substance is made to be 15% or less (in weight percent), whereby the luminescence of white electric arc is obtained in which unevenness in blue tone is minor.

More specifically, Zn is a light-emitting substance which becomes luminous in blue, and is sealed inside the discharge emission chamber as $ZnI_2$ in place of Hg which is a buffering substance. As shown in FIG. 7, when the content of Zn in the sealed light-emitting substance is in the range of 15% or less (in weight percent), the color unevenness in the electric arc (a difference in color temperature (ΔCCT) between red on the cathode side and blue on the anode side of the electric arc) falls within the permissible value (1000K or less), whereby a white light having a sufficient luminance is obtained in which blue tone in the electric arc (in particular, extreme luminescence in blue on the anode side of the electric arc) is suppressed. When the content of $ZnI_2$ in the light-emitting substance exceeds 15% (in weight percent), the luminescence of $ZnI_2$ on the cathode side becomes excessive (ΔCCT exceeds 1000K). For this reason, the content of $ZnI_2$ in the light-emitting substance is adjusted to fall within the range of 15% or less (in weight percent) where the white electric arc is obtained with little unevenness in blue tone.

Although NaI is sealed inside the discharge emission chamber S as a red light-emitting substance in the first exemplary embodiment, other alkaline metal halide may be contained in place of NaI with a content of 40% to 70% (in eight percent) with respect to the whole light-emitting substance sealed inside the discharge emission chamber S.

Figure 2:
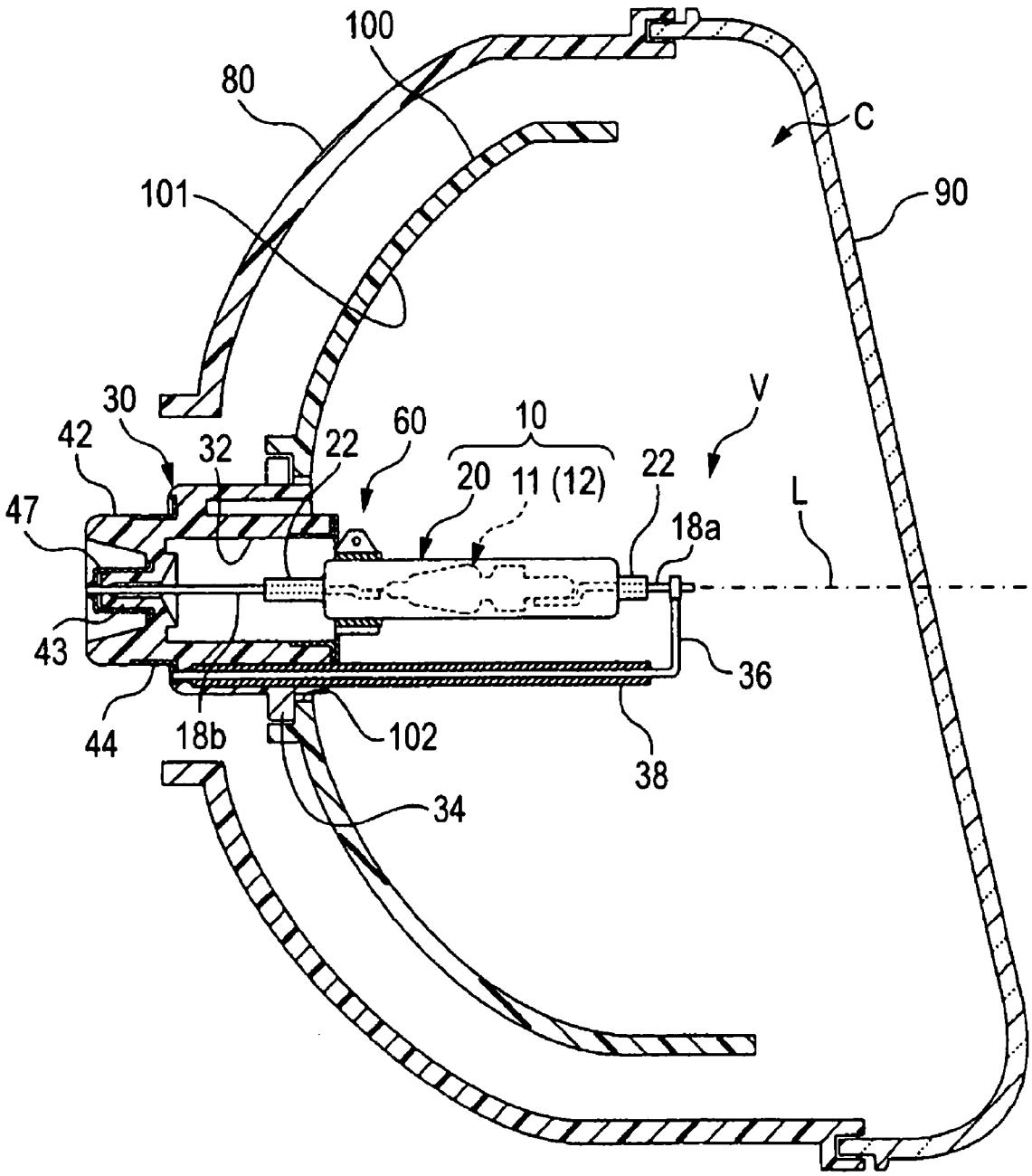
FIG. 2 is a vertical longitudinal sectional view (a sectional view taken along the line II-II shown in FIG. 1) of the vehicle headlamp.

As shown in FIGS. 2 and 3, the arc tube 10 (the arc tube body 11) is disposed in front of the insulating base 30 and is integrated with the insulating base 30, such that the large diameter rod-shaped electrode 15*a* serving as the anode is disposed on the front side of the bulb V (the small-diameter rod-shaped electrode 15*b* serving as the cathode being disposed on the rear of the bulb V). In this way, a large maximum central luminance can be obtained in the light distribution of a vehicle headlamp in which the discharge bulb V is used as a light source.

Figure 5:
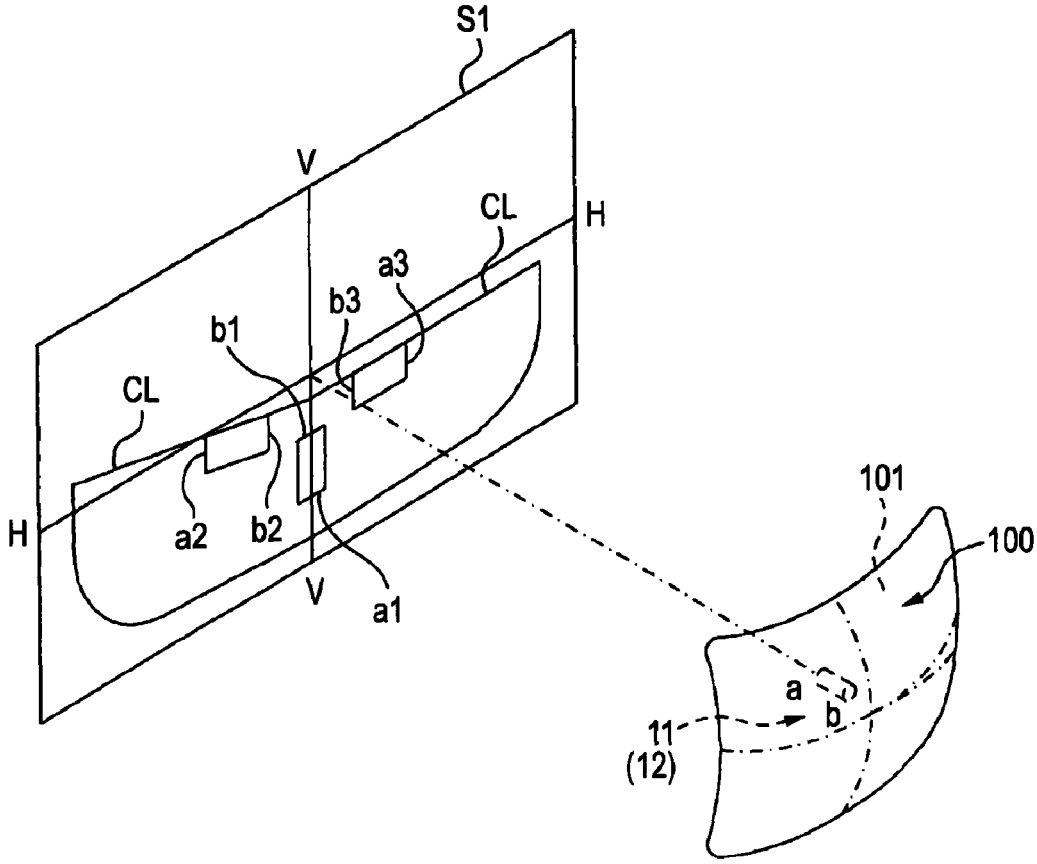
FIG. 5 is a perspective view illustrating a state in which an effective reflecting surface of a reflector is being designed by projecting (affixing) a light source image onto a light distribution screen.

More specifically, as shown in FIGS. 5 and 6, the effective reflecting surface 101 of the reflector 100 is designed by projecting (affixing) light source images of the discharge emission portion (the electric arc) ab onto a light distribution screen S1 disposed in front of the reflector 100 such that the light source images are projected to radiate from an elbow portion of a cut-off line as a center. As for a positional relationship between the discharge emission portion (electric arc) ab and light source images a1b1, a2b2, a3b3 of the discharge emission portion (electric arc) ab that are projected (affixed) onto the light distribution screen S1, a front end side a of the discharge emission portion (electric arc) ab corresponds to outer sides a1, a2, a3 in the radiated direction, while a rear end side b of the discharge emission portion (electric arc) ab corresponds to the elbow portion sides b1, b2, b3.

Since Na ions having a high luminescence efficiency are drawn to the cathode side, the luminance becomes high on the rear end side (the reflector 100 side) of the discharge emission portion (electric arc) ab. Therefore, highly luminous portions (the sides which lie to face the elbow portion in the cut-off line) b1, b2, b3 of the light source images affixed onto the light distribution screen S1 form a hot zone Hz in the vicinity of the elbow portion in the cut-off line, thereby increasing the maximum center luminance of the light distribution.

Figure 8:
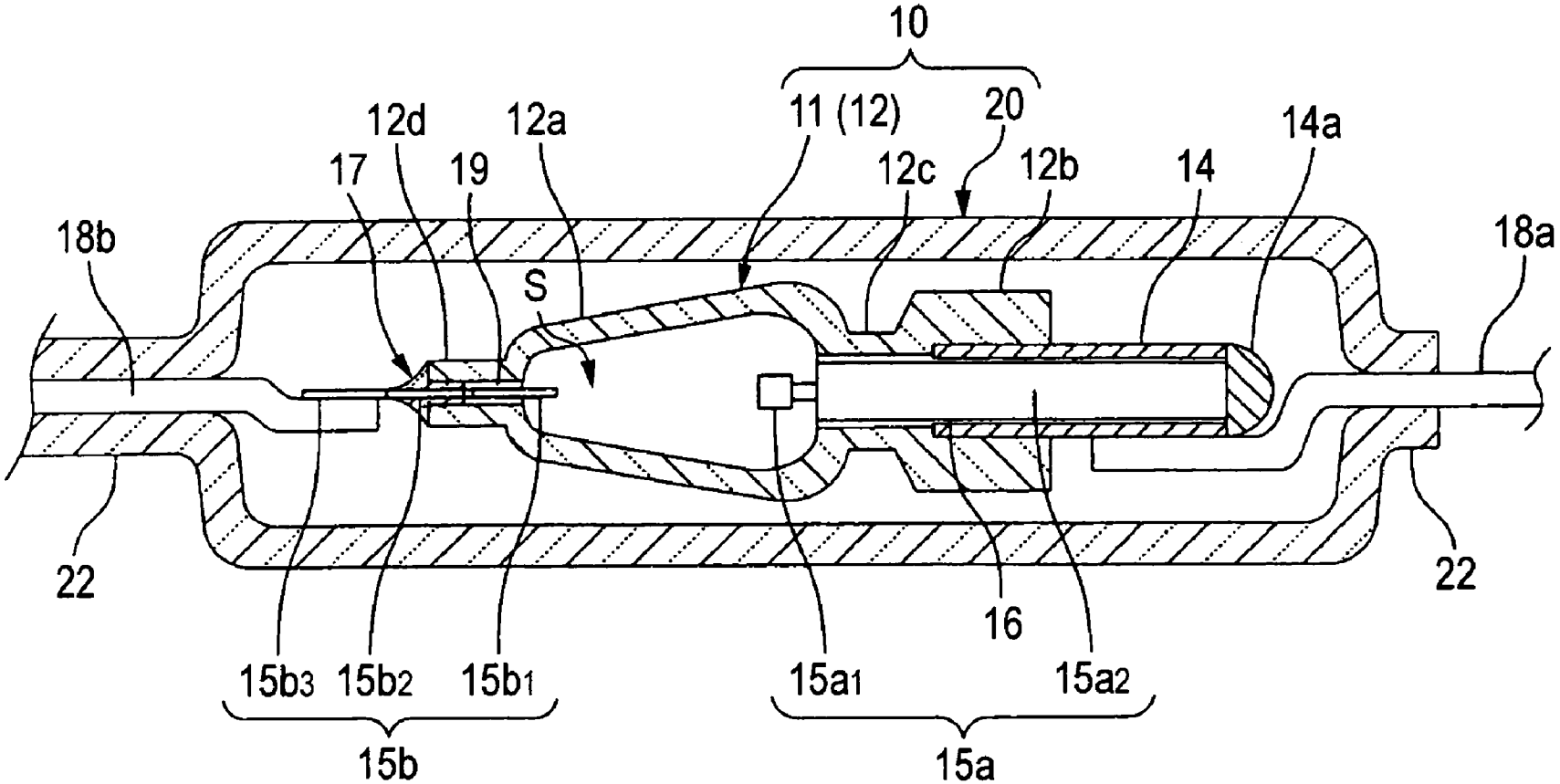
FIG. 8 is an enlarged vertical longitudinal sectional view of an arc tube of a direct-current high-voltage discharge bulb according to a second exemplary embodiment of the invention.
Figure 9:
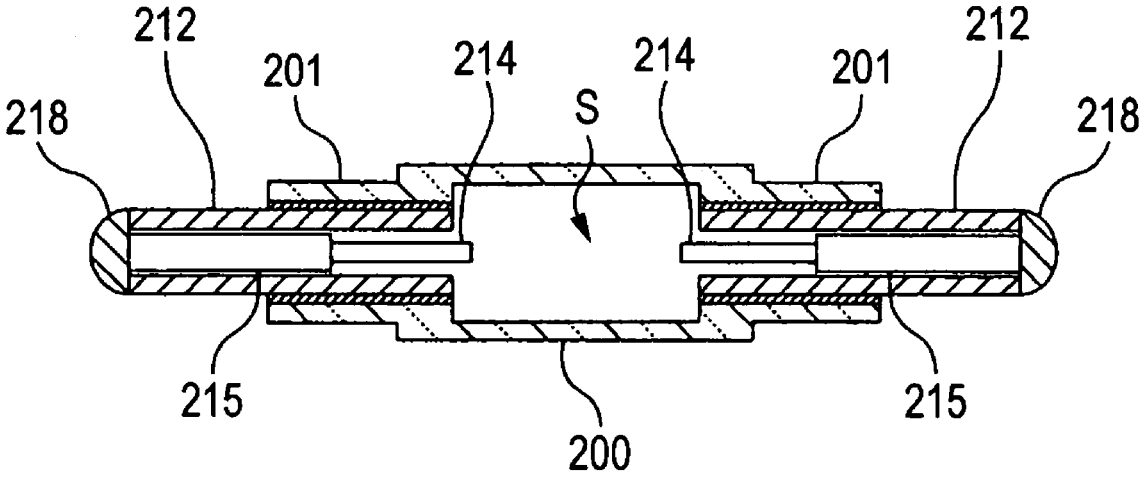
FIG. 9 is a vertical longitudinal sectional view of an arc tube body of a discharge bulb according to a related art.

FIG. 8 is an enlarged vertical longitudinal sectional view of an arc tube of a discharge bulb according to a second exemplary embodiment of the invention.

In the first exemplary embodiment that has been described above, the glass weld 17 serving as the electrode sealing portion on the cathode side of the arc tube body 11 is formed over substantially the whole area of the inner circumference of the small-diameter thin tube portion 12*d*. However, in the second exemplary embodiment, the same glass weld 17 is formed only on an open side of the small-diameter thin tube portion 12*d*, whereby a minute gap 19 is formed in the interior of the small-diameter thin tube portion 12*d* on a side that faces a discharge emission chamber S. Since the other features of the second exemplary embodiment are the same as those of the first exemplary embodiment, same reference numerals are given to the same features and repetition of the same description is omitted.

Also in the second exemplary embodiment, the thermal capacity of an arc tube body 11 is smaller on a cathode side than on an anode side, so that the temperature on the cathode side of the arc tube body 11 when it is lit is made close to the temperature on the anode side, whereby the temperature distribution in the discharge emission chamber S becomes substantially uniform and color unevenness in an electric arc is not amplified. Therefore, the color unevenness in the electric arc is sufficiently mitigated (absorbed) by a ceramic tube 12 having a low linear transmission factor (for example, 80% or less) and by which an emitted light is diffused. In addition, a coldest point moves from the vicinity of the cathode towards the anode side (a position which lies slightly away from the cathode towards the anode side becomes the coldest point), whereby a light-emitting substance is unlikely to be liquefied or solidified in the minute gap 19 between the small-diameter thin tube portion 12*d* and a rod-shaped electrode 15*b*, thereby eliminating the decrease in quantity of light-emitting substance contributing to luminescence in the discharge emission chamber S. Therefore, it possible to eliminate the risk that the performance characteristic decreases or the luminous flux decreases.

While the electrode sealing portion on the cathode side of the arc tube body 11 in the above exemplary embodiments is the glass weld 17, namely, the rod-shaped electrode 15*b* is inserted through the small-diameter thin tube portion 12*d* on the cathode side of the ceramic tube 12 and is frit sealed, the same construction as that on the anode side (the construction in which the end portion of the rod-shaped electrode is welded to the molybdenum pipe that is joined to the small-diameter thin tube portion by metallization) may be adopted.

According to the exemplary embodiments, a direct-current high-voltage discharge bulb produces white luminescence having less color unevenness that is available as a light source of a vehicle lamp, the direct-current high-voltage discharge bulb having superior performance characteristic and a sufficient luminous flux.

More specifically, in the direct-current high-voltage discharge bulb, the reddish tone in the electric arc (in particular, the extreme reddish luminescence on the cathode side of the electric arc) is suppressed, whereby the color unevenness in red is mitigated so that the white light distribution that is desirable as a light source of a vehicle lamp can be obtained. Moreover, the blue tone in the electric arc (in particular, the extreme blue luminescence on the anode side of the electric arc) is suppressed, whereby the color unevenness in blue is mitigated so that the white light distribution that is desirable as a light source of a vehicle lamp can be obtained.

The direct-current high-voltage discharge bulb according to the exemplary embodiments can also form the light distribution having a highly luminous hot zone in the vicinity of the elbow portion in the cut-off line, such light distribution being desirable for a vehicle lamp.

While description has been made in connection with exemplary embodiments of the present invention, it will be obvious to those skilled in the art that various changes and modification may be made therein without departing from the present invention. It is aimed, therefore, to cover in the appended claims all such changes and modifications falling within the true spirit and scope of the present invention.

What is claimed is:

1. A direct-current high-voltage discharge bulb for a vehicle lamp, comprising:

a ceramic arc tube body having a discharge emission chamber at a middle portion in a longitudinal direction thereof;

a light-emitting substance which is sealed inside the discharge emission chamber together with a starting rare gas; and an anode and a cathode which are disposed so as to face each other inside the discharge emission chamber, wherein an inside diameter of the ceramic arc tube body where the discharge emission chamber is defined is made to gradually decrease from a side of the anode to a side of the cathode;

wherein the inside diameter gradually decreases from a distal end of the anode to a distal end of the cathode;

wherein a first distance between an outer circumference of the anode at the distal end of the anode and a tube wall of the arc tube body is larger than a second distance between an outer circumference of the cathode at the distal end of the cathode and the tube wall of the arc tube body;

wherein a volume of the cathode is smaller than a volume of the anode.

2. The direct-current high-voltage discharge bulb for a vehicle lamp according to claim 1, wherein the light-emitting substance includes an alkaline metal halide, a weight percentage of the alkaline metal halide in relation to the light-emitting substance being in a range of 40% to 70%.

3. The direct-current high-voltage discharge bulb for a vehicle lamp according to claim 2, further comprising an insulating base, wherein the ceramic arc tube body is fixedly held in front of the insulating base such that the anode side of the ceramic arc tube body is disposed on a front side.

4. The direct-current high-voltage discharge bulb for a vehicle lamp according to claim 2, wherein the alkaline metal halide is NaI.

5. The direct-current high-voltage discharge bulb for a vehicle lamp according to claim 1, wherein the light-emitting substance includes ZnI2, a weight percent of ZnI2 in relation to the light-emitting substance being 15% or less.

6. The direct-current high-voltage discharge bulb for a vehicle lamp according to claim 5, further comprising an insulating base, wherein the ceramic arc tube body is fixedly held in front of the insulating base such that the anode side of the ceramic arc tube body is disposed on a front side.

7. The direct-current high-voltage discharge bulb for a vehicle lamp according to claim 1, further comprising an insulating base, wherein the ceramic arc tube body is fixedly held in front of the insulating base such that the anode side of the ceramic arc tube body is disposed on a front side.

8. The direct-current high-voltage discharge bulb for a vehicle lamp according to claim 1, wherein the ceramic arc tube body includes a pair of thin tube portions, each of the thin tube portions formed on respective side portions thereof, wherein a volume of the thin tube portion on the cathode side is smaller than a volume of the thin tube portion on the anode side.

9. The direct-current high-voltage discharge bulb for a vehicle lamp according to claim 1, further comprising a glass weld, wherein the ceramic arc tube body includes a pair of thin tube portions, each of the thin tube portions formed on respective side portions thereof, and the glass weld is disposed between the cathode and the thin tube portion on the cathode side.

10. The direct-current high-voltage discharge bulb for a vehicle lamp according to claim 1, wherein a linear transmission factor of the ceramic arc tube body is 80% or less.

11. The direct-current high-voltage discharge bulb for a vehicle lamp according to claim 1, wherein the ceramic arc tube body includes a pair of thin tube portions, each of the thin tube portions formed on respective side portions thereof, a seal is disposed in a gap between the cathode and the thin tube portion on the cathode side, and an open gap is formed between the anode and the thin portion on the anode side.

* * * * *